US008425211B2

(12) United States Patent
Spinnler

(10) Patent No.: US 8,425,211 B2
(45) Date of Patent: Apr. 23, 2013

(54) POSITIVE DISPLACEMENT MACHINE ACCORDING TO THE SPIRAL PRINCIPLE

(75) Inventor: Fritz Spinnler, Mellingen (CH)

(73) Assignee: Spinnler Engineering, Mellingen (CH)

( * ) Notice: Subject to any disclaimer, the term of this patent is extended or adjusted under 35 U.S.C. 154(b) by 502 days.

(21) Appl. No.: 12/674,068

(22) PCT Filed: Jul. 10, 2008

(86) PCT No.: PCT/CH2008/000309

§ 371 (c)(1),
(2), (4) Date: Feb. 18, 2010

(87) PCT Pub. No.: WO2009/023974

PCT Pub. Date: Feb. 26, 2009

(65) Prior Publication Data

US 2011/0027116 A1 Feb. 3, 2011

(30) Foreign Application Priority Data

Aug. 22, 2007 (CH) ..... 1319/07

(51) Int. Cl.

| | |
|---|---|
| ***F01C 1/02*** | (2006.01) |
| ***F01C 1/063*** | (2006.01) |
| ***F03C 2/00*** | (2006.01) |
| ***F03C 4/00*** | (2006.01) |
| ***F04C 2/00*** | (2006.01) |
| ***F04C 18/00*** | (2006.01) |

(52) U.S. Cl.

USPC ..... 418/55.1; 418/55.2; 418/55.3; 418/55.4; 418/55.6; 418/60

(58) Field of Classification Search ..... 418/55.1–55.6, 418/60, 61.1

See application file for complete search history.

(56) References Cited

U.S. PATENT DOCUMENTS 4,861,244 A * 8/1989 Kolb et al. ..... 418/15
5,024,589 A * 6/1991 Jetzer et al. ..... 418/55.3

(Continued)

FOREIGN PATENT DOCUMENTS

DE 26 03 462 8/1976
DE 31 07 231 A1 9/1982

(Continued)

*Primary Examiner* — Kenneth Bomberg
*Assistant Examiner* — Dapinder Singh
(74) *Attorney, Agent, or Firm* — Henry M. Feiereisen LLC

(57) ABSTRACT

In a positive displacement machine for compressible media, having a spiral-shaped feed chamber (11) arranged in a housing (7*b*) between cylinder walls (14, 15), a spiral-shaped displacement body is composed of a disc (2) with spiral-shaped strips (3). The strips (3) are held eccentrically with respect to the housing, in such a way that, during operation, each point of the strip performs a movement which is limited by the peripheral walls of the feed chamber. The contour (20) of the disc is formed, in the overlapped region of the spiral at the point provided for the mutual sealing of the traversed chambers (11, 16), in the shape of the movement path. The housing edge (19) is formed, as a transition between the raised first part (17) and lowered second part (18) of the outer cylinder wall (14) of the housing, as a bulbous thickened portion. The radial extent "D" of the thickened portion is at least as great as the degree of eccentricity ("e"). In periods of machine operation, in which a higher pressure prevails in the outer, sickle-shaped working space (11) than in the suction chamber (16), the circular-arc-shaped projection (19) together with the contour of the disc forms a sealing line (21) which extends over the height of the projection.

2 Claims, 6 Drawing Sheets

U.S. PATENT DOCUMENTS

| | | | | | |
|---|---|---|---|---|---|
| 5,171,140 | A | * | 12/1992 | Schafer et al. | 418/55.2 |
| 5,318,425 | A | * | 6/1994 | Jetzer et al. | 418/55.6 |
| 5,322,426 | A | * | 6/1994 | Kolb | 418/55.2 |
| 5,356,276 | A | * | 10/1994 | Spinnler | 418/55.2 |
| 5,397,223 | A | * | 3/1995 | Spinnler et al. | 418/55.6 |
| 6,116,875 | A | * | 9/2000 | Kolb et al. | 418/55.2 |
| 6,132,193 | A | * | 10/2000 | Kolb et al. | 418/55.3 |
| 2003/0138339 | A1 | * | 7/2003 | Scancarello | 418/55.2 |
| 2010/0202910 | A1 | * | 8/2010 | Yamamoto et al. | 418/55.2 |

FOREIGN PATENT DOCUMENTS

| | | | |
|---|---|---|---|
| DE | 32 31 754 | A1 | 3/1984 |
| DE | 32 31 756 | A1 | 3/1984 |
| DE | 34 07 939 | C1 | 7/1985 |
| DE | 19980588 | C2 | 5/2002 |
| EP | 0 284 774 | A | 10/1988 |
| EP | 0 560 009 | A | 9/1993 |
| JP | 60 132085 | A | 7/1985 |
| JP | 2000352384 | A | 12/2000 |

* cited by examiner

POSITIVE DISPLACEMENT MACHINE ACCORDING TO THE SPIRAL PRINCIPLE

CROSS-REFERENCES TO RELATED APPLICATIONS

This application is the U.S. National Stage of International Application No. PCT/CH2008/000309, filed Jul. 10, 2008, which designated the United States and has been published as International Publication No. WO 2009/023974 and which claims the priority of Swiss Patent Application, Serial No. 1319/07, filed Aug. 22, 2007, pursuant to 35 U.S.C. 119(a)-(d).

FIELD OF THE INVENTION

The invention relates to a positive displacement machine for compressible media.

STATE OF THE ART

Positive displacement machines according to the spiral configuration are known, for example, from DE 2603462. A compressor constructed in accordance with this principle is characterized by a near pulsation-free conveyance of the gaseous operating fluid comprised for example of air or an air-fuel mixture and could therefore be used advantageously i.a. also for charging purposes in internal combustion engines. During operation of such a compressor several, substantially sickle-shaped work spaces are enclosed along the displacement chamber between the spiral-shaped rotor and the two peripheral walls and move from the inlet through the displacement chamber to the outlet, with their volume steadily decreasing and the pressure of the operating fluid increasing accordingly.

A machine of the afore-stated type, in which the spirals span a total angle of wrap of about 360°, is known from DE 3407939 C1. In such a machine, the rotor, called there rotation piston, is held at its terminal entry side for guidance in relation to the housing by a swing of a length which is greater than the length of the drive crank. The disc supporting the spiral-shaped strips terminates with the outer contour of the non-overlapping strips and the contour of the disc is configured in the overlapped region in the form of the movement path which defines a housing edge which is created by the required lowering of the outer cylinder wall of the feed chamber at one housing half for receiving the disc, when the rotor swings inwards in this region. A residual gap which varies in dependence on the position of the rotation piston remains between the housing edge and the disc and short-circuits the feed chambers at the inlet and the outlet of the spiral. This means for a transport of the compressible medium from outside to the inside that a return flow occurs through this residual gap. This residual gap should stay the same during half a crank revolution so that the contour of the disc approximates a S-shape. This rotary piston machine should prevent the number and the length of gaps, which produce pressure loss, between the respective pressure and suction chambers, resulting in a reduction in power loss. As the disc which supports the spiral-shaped strips terminates with the outer contour of the non-overlapped strips, the machine is characterized by a small structural size and low weight.

Such a more than 20 years old machine which in principle has a real seal is no longer appropriate to meet current demands because, on one hand, the presence of a residual gap with permanent communication between pressure and suction chambers is basically no longer admissible, and, on the other hand, a residual gap, even if small, which remains the same only over half a crank revolution, is inadequate to ensure the required tightness.

ILLUSTRATION OF THE INVENTION

The invention is therefore based on the object to provide a machine of the afore-stated type which effects a complete mutual sealing, in particular in a low speed range of neighboring feed chambers in which different pressures prevail.

This object is solved by a positive displacement machine for compressible media, with a spiral-shaped feed chamber arranged in a fixed housing between cylinder walls for arrangement of a spiral-shaped displacement body, including essentially a disc, and spiral-shaped strips mounted on at least one side of the disc and held eccentrically in relation to the housing in such a way that each point of the strips executes during operation a movement which is limited by the peripheral walls of the feed chamber, with the disc which supports the spiral-shaped strips terminating with the outer contour of the non-overlapped strips, and with the contour of the disc being configured in the overlapped region at the location provided for the mutual sealing of the traversed chambers in the form of the movement path which defines a housing edge, which housing edge is established by the required lowering of the outer cylinder wall of the feed chamber on at least one of the housing halves for receiving the disc during inward swinging of the displacement body in this region, wherein the housing edge is configured as transition between raised first part and lowered second part of the outer cylinder wall as bulbous thickened portion having in radial direction an extent which is sized at the widest location at least half as great as the degree of the eccentricity, and wherein in the periods during operation of the machine in which a higher pressure prevails in the outer sickle-shaped work space, defined by the strips and the outer cylinder wall, than in the suction chamber arranged radially outside the outer cylinder wall, this bulbous thickened portion cooperates with the contour of the disc in order to form a sealing line which extends over the height of the transition.

The advantages of the invention can be seen in its application in a positive displacement machine with swing as guide element for the displacement member as well as with guide shaft for guiding the displacement member, as known for example from DE 3107231 A1. In addition, the invention allows—viewed in radial direction—a free arrangement of the swing to the outside, in the event such is presumed as guide element. In particular effective is the invention when used in machines with internal compression, as described above in the mentioned DE 2603462 and illustrated in DE 3107231 A1, also afore-mentioned.

BRIEF DESCRIPTION OF THE DRAWING

An exemplified embodiment of the invention is schematically illustrated in the drawing.

It is shown in.

PATH FOR IMPLEMENTATION OF INVENTION

For explanation of the mode of operation of the compressor which is not the subject matter of the invention, reference is made to the afore-mentioned DE 2603462 A1. The following description briefly relates only to the machine construction and process sequence that is required for understanding.

Figure 1:
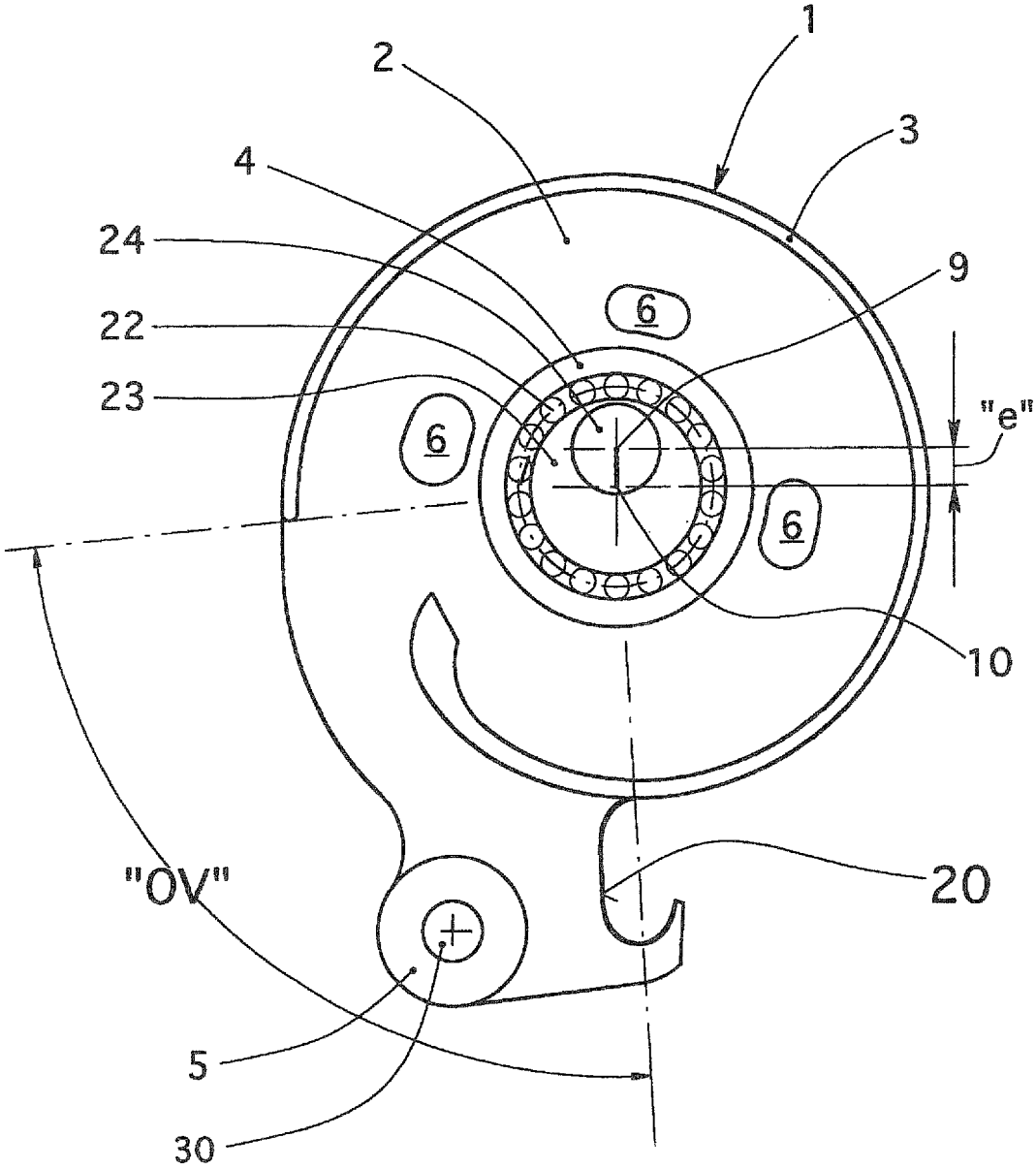
FIG. 1 a rotor.

1 designates in the drawing overall the rotor of the machine. The rotor 1 includes a disc 2 and spiral strips 3 axially projecting perpendicularly from both sides of the disc 2. According to FIG. 1, the spiral, i.e. the strip 3, is formed of several adjoining circular arcs and has an angle of wrap of about 360°. The outlet-side end of the spiral is hereby equipped with a slight, so-called internal, compression, as known from the afore-mentioned DE 2603462 A1. This is notable insofar as the internal compression effects a higher pressure in the work space to realize a required reliable sealing. The disc 2 is provided on the spiral outlet with several openings 6 in order for the medium to be able to flow from one disc side to the other one, for example in order to be tapped when a central outlet 13 (FIG. 2) is provided on only one side. 4 designates the hub by which the disc 2 is mounted via a rolling-contact bearing 22 on an eccentric disk 23. The latter in turn is part of a driveshaft 24. "e" relates to the eccentricity between the axis 9 of the driveshaft 24 and the axis 10 of the eccentric disc 23.

The illustration shows that the disc 2 which supports the spiral-shaped strips 3 terminates over the major part of its circumference with the outer contour of the strips 3. This region relates to the non-overlapped spiral region and is instrumental for keeping the outer diameter of the machine small. The angle measure "OV" designates the overlapped region of the spiral. In that region, the disc 2 projects radially beyond the strips 3. 5 designates in this region "OV" an eye arranged radially outside the strips 3 for receiving an unillustrated guide bearing which is mounted on a guide bolt 30. The contour 20 of the disc 2 is matched at the location provided for the mutual sealing of the (later to be described) feed chambers 11 in the form of the movement path of the disc. By way of example, it is configured in the form of an ellipse.

Figure 2:
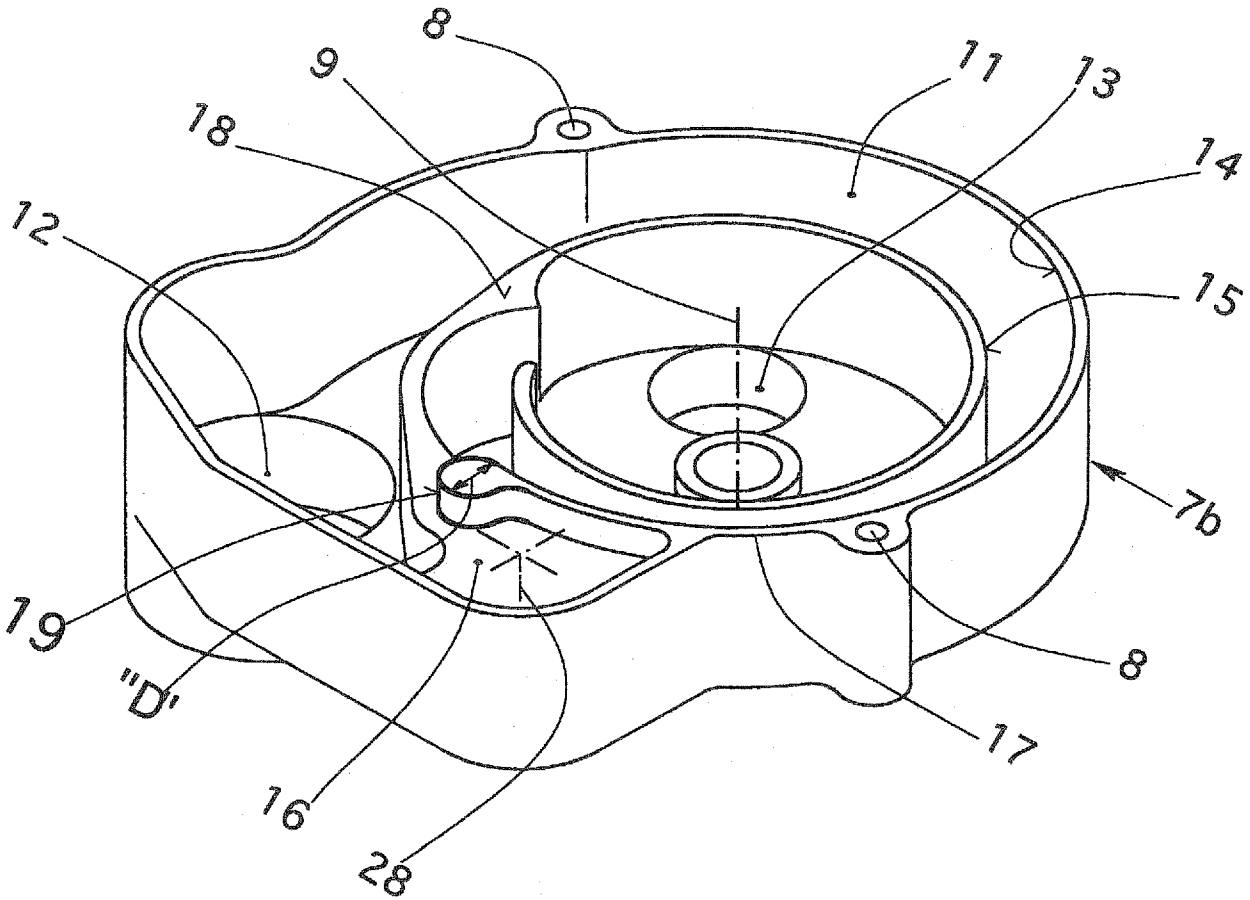
FIG. 2 a view of a housing portion with configuration of the housing edge in accordance with the invention, FIG. 3 a longitudinal section through the machine, FIG. 4 a top view of the housing portion of FIG. 2 with installed rotor according to FIG. 1, FIGS. 5-6 top views like in FIG. 4, however with varying angular positions of the eccentric drive.

FIG. 2 shows the housing half 7*b* of the machine housing comprised of two halves and connected to one another via fastening eyes 8 for receiving screwed connections. 11 designates the feed chamber which is incorporated in both housing halves in the form of a spiral-shaped slot. It extends parallel from an inlet 12 in the housing at an outer circumference of the spiral to an outlet 13 provided in the housing interior. The feed chamber 11 has cylinder walls 14, 15 which are arranged essentially parallel substantially at a same distance to one another and exhibit a spiral like the strips 3. Provided in a suction chamber 16 which connects the inlet 12 with the feed chamber 11 is an axis 28 for the rotatable support of a part of the guiding device.

As it projects in the region "OV" beyond the strips 3, the disc 2 has to traverse at least one housing half. This is realized in the present case at the illustrated housing half 7*b*. For this purpose, the inner web 18 of the housing half 7*b* is lowered at a suitable location of the housing—preferably at one edge of the overlapped region "OV" of the spiral—in relation to the outer web 17 by the amount of the disc thickness. This measure has, i.a., the benefit that the arrangement of a sealing strip (not shown) in the lower housing half 7*b* is only required at the inner web for sealing the feed chamber 11 up to the outlet 13 against the suction chamber 16. This required lowering of the outer cylinder wall at at least one housing half, here 7*b*, for receiving the disc 2 as the rotor swings inwards in this region, results in a housing edge 19.

Figure 3:
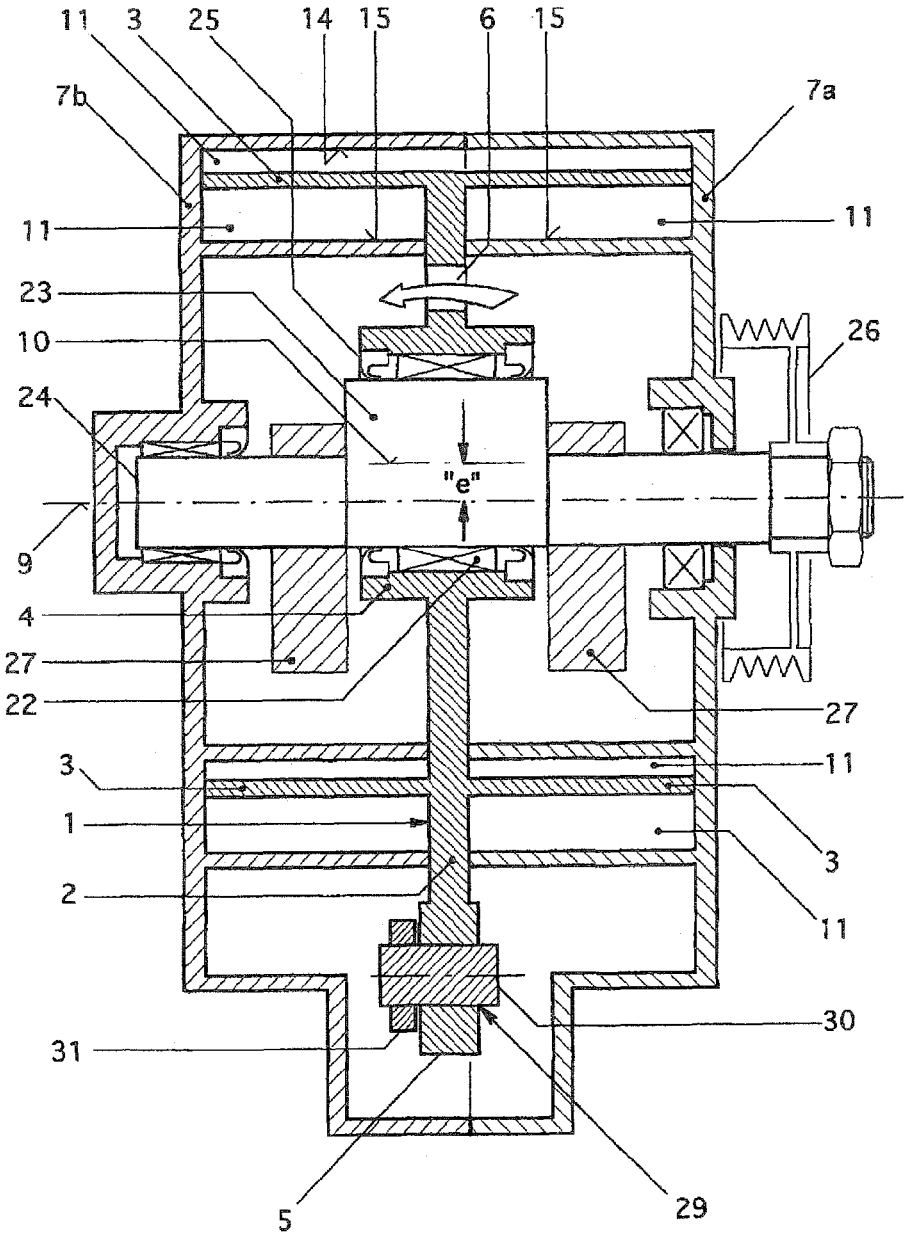

The longitudinal section according to FIG. 3, depicting the assembled machine, shows that the driveshaft 24 is supported in both housing halves 7*a* and 7*b* by rolling-contact bearings not labeled in greater detail. The driveshaft is caused to rotate by a pulley 26. The drive of the rotor 1 is implemented by the driveshaft 24 via the eccentric disc 23. The bearing 22, shown here as rolling-contact bearing, seats on this disc 23 and is sealed on both sides by shaft sealing rings 25 against the housing interior. Counterweights 27 are fitted upon the driveshaft 24 also on both sides of the eccentric disc 23.

The rotor 1 is guided by the guiding device 29. Depending on whether the guiding device 29 is a swing or a guide shaft (not shown) running in synchronism with the driveshaft, all points on the strips 3 execute a displacement motion which resembles an ellipse or is circular. In the present example, the guiding device 29 includes a swing 31 having one end supported for rotation about the axis 28 in the housing (FIG. 2), while the other end engages via the guide bolt 30 in the eye 5 of the rotor.

Figure 4:
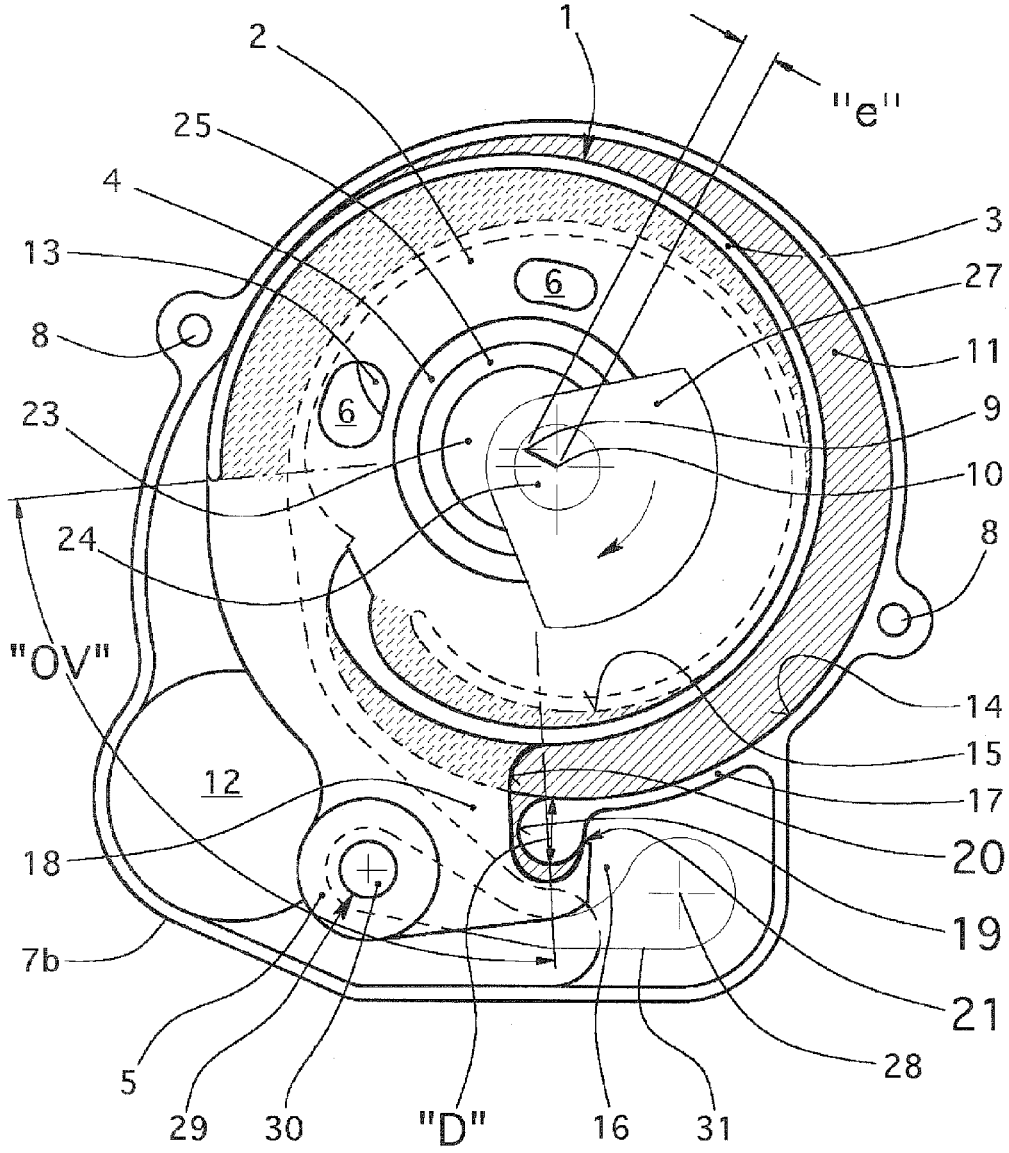

FIG. 4 shows that the strips 3 engage between the cylinder walls 14 and 15 of the housing 7, when the rotor 1 is installed. The cylinder walls have a curvature which is so dimensioned that the strips almost touch the inner 15 and the outer 14 cylinder wall for example at one location respectively. During operation, the strips 3 glide with line contacts in relation to the cylinder walls 14 and 15. As a result of the multiply alternating approach of the strips 3 towards the inner 15 and outer 14 cylinder walls, respectively, of the feed chamber 11, sickle-shaped work spaces to enclose the operating fluid are realized on both sides of the strips 3 and are shifted through the feed chamber 11 in the direction of the central outlet 13 during operation of the rotor disc 2. The volumes of these work spaces decrease hereby and the pressure of the operating fluid is increased accordingly.

Such positive displacement machines are known or at least deducible by experts when interpreting the afore-mentioned prior art; However, they exhibit the afore-mentioned shortcomings. In order to ensure during operation a complete sealing of traversed neighboring chambers relative to one another in which different pressures prevail, the interacting elements 19 and 20 are adapted to one another in accordance with the invention. In the following, the term "circular-arc-like" is used because the projection in the disc, i.e. its decisive contour, relates only to its disposition at the periphery of the disc and does not relate to the precise description of its geometric configuration. The latter is in fact determined by the type of used guiding device. For example, when a double-shaft eccentric drive is involved, all points of the rotor describe a circle, in the event of a swing as guide element, only the center of the hub of the rotor describes a circle, whereas the remaining points describe a curve that resembles an ellipse. As shown in FIG. 4, the following description is based on the provision of a swing 31 as guiding device 29. This solution affords the possibility to arrange the interacting elements 19 and 20 geometrically between both bearing points of the guiding device 29. This has the advantage that the overlapped region "OV" and the weight of the rotor can be kept to a minimum. Moreover, the flow path between inlet 12 and suction chamber 16 is shortened.

The essential elements are adjusted to one another in order to attain a correct mode of operation in the following manner: The housing edge 19 which forms the transition between raised first part 17 and lowered second part 18 of the outer cylinder wall 14 is configured as bulbous thickened portion having in radial direction an extent "D" which should be sized at the widest location of the thickened portion at least half as great as the degree of the eccentricity "e". In the present example, the thickened portion is configured in the form of a circular projection, with the extent "D" representing in this case the diameter of the projection and sized slightly greater than the eccentricity "e". The contour 20 of the disc is then configured in the form of its movement path, depending on the geometry of the thickened portion in a shape resembling a circular arc, here in the shape of an ellipse. All those operating states form a base in which a higher pressure prevails in the outer sickle-shaped work space, which is defined by the strips 3 and the outer cylinder wall 14, than in the suction chamber 16 outside the second part 18 of the outer cylinder wall 14. In these periods, no return flow should be possible from the sickle-shaped work space. The contour 20 is hereby sized such that the contour cooperates with the circular projection of the housing edge 19 during these periods. This involves a cooperation to establish an actual sealing line 21 which extends over the height of the projection.

Figure 5:
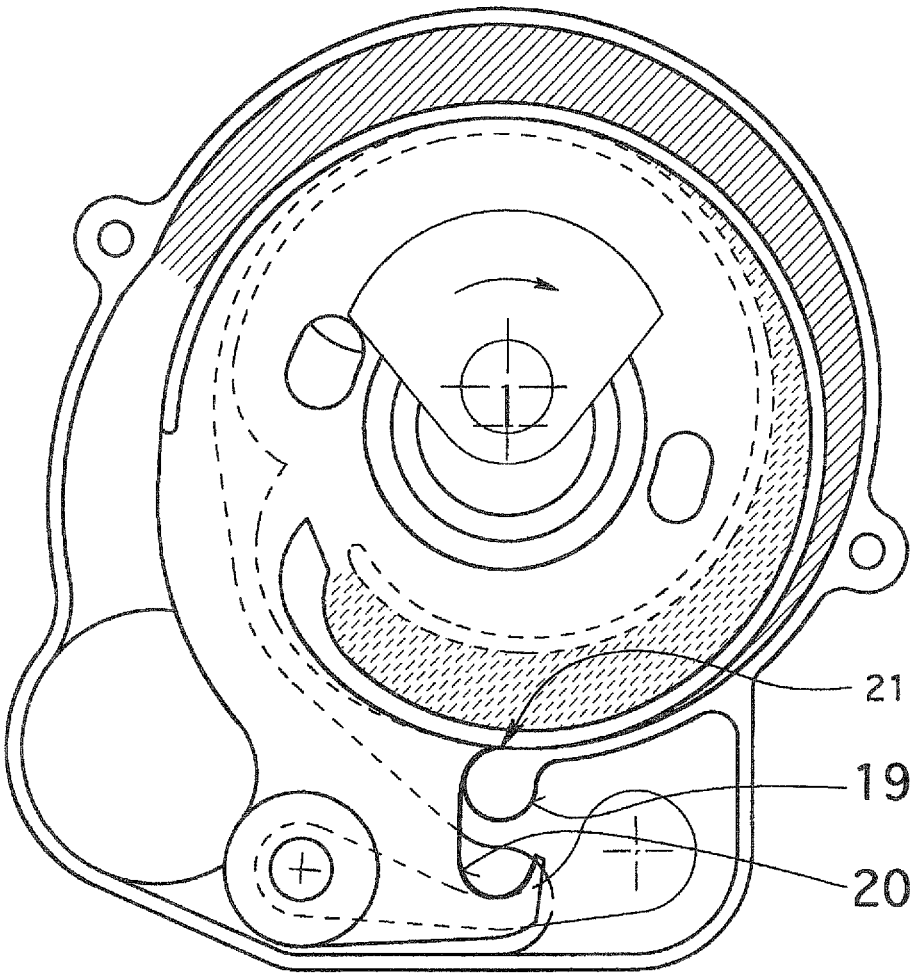
Figure 6:
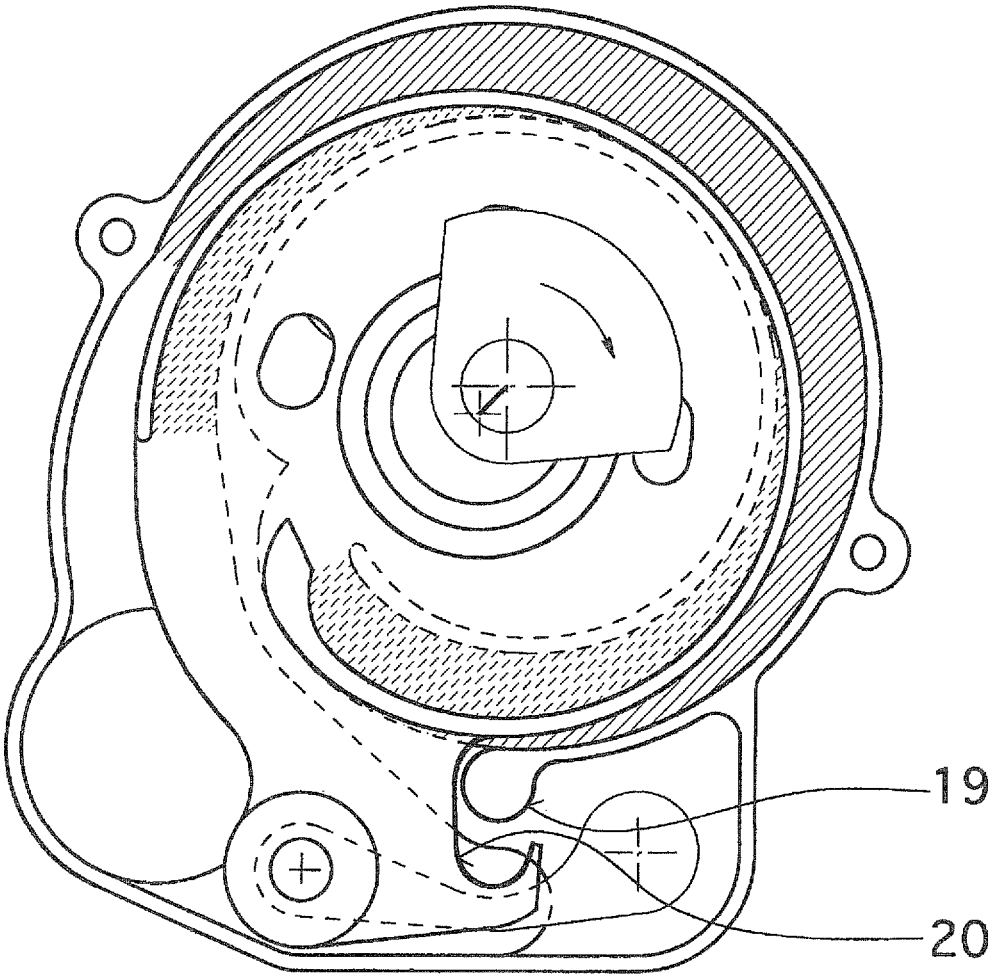

The manner in which the housing edge 19 cooperates during operation of the machine in order to form a sealing line 21 with the recess 20 of the disc is shown in FIGS. 4 to 6. The respective angular position of the rotor can be recognized simply by the position of the counterweights 27.

FIG. 4 depicts the position of the rotor 1 in which the sickle-shaped outer work space formed by the strips 3 and the outer cylinder wall 14 is fully enclosed. It can be seen that the sealing line 21 is in engagement. This illustration also shows that the diameter "D" of the edge 19, so long it is shaped circular, must have a certain minimum size in order to maintain a reliable interaction. Merely rounding the housing wall to be broken away, as known from the mentioned DE 3407939 C1 does not lead to success.

As the rotor 1 moves in transport direction, which is indicated in FIG. 4 by an arrow within the counterweight 27, this outer sickle-shaped work space decreases in volume and is connected with the central outlet 13. The pressure in the work space increases; the sealing against the suction chamber 16 is established as the circular-arc-shaped/-like recess 20 rolls on the edge to steadily form a sealing line 21.

FIG. 5 shows the outermost angular disposition which still maintains a sealing. Expulsion of operating fluid from the outer work space is almost accomplished. Operating fluid is already also expelled from the inner work space. This outermost sealing line is eminently important in order to prevent a flow of compressed operating fluid from the spiral end back into the suction chamber.

In summary, it can be seen that the present invention realizes a type of sealing which reliably operates across an angular range of about 250°.

FIG. 6 shows the region which renders the presence of a sealing not only unnecessary but, in fact, undesired. The contour 20 has now been detached from the edge 19; no sealing takes place in this region. At this instance, operating fluid is conveyed at the spiral end from the inner work space towards the outlet 13 and drawn at the spiral beginning already again from the inlet 12 into the inner work space. The outer work space is open towards the suction chamber 16 at the spiral end and towards the inlet 12 at the spiral beginning. Backflow of compressed operating fluid from the inner work space about the spiral end into the suction chamber 16 is not possible because at this point in time the strip 3 seals against the outer cylinder wall 14 in the outlet-side region of the spiral.

What is claimed is:

1. A spiral compressor for compressible media, comprising:

a fixed housing having a spiral-shaped feed chamber arranged between cylinder walls of the housing; and a rotor arranged in the feed chamber and mounted on a driveshaft provided with an eccentric disc, thereby defining an eccentricity between the driveshaft and the eccentric disc, said rotor including a disc, and spiral-shaped strips mounted on sides of the disc in one to one correspondence to said sides and held eccentrically in relation to the housing in such a way that each point of the strips executes during operation a movement which is limited by peripheral walls of the feed chamber, wherein the disc which supports the spiral-shaped strips terminates with an outer contour in a non-overlapped region, and wherein the disc has a contour which is configured in an overlapped region, in which the disc projects radially beyond the strips, at a location provided for a mutual sealing of traversed chambers in the form of a movement path which defines a housing edge, said housing edge being established by a lowering of an outer one of the cylinder walls of the feed chamber on at least one of two housing halves of the housing for receiving the disc during inward swinging of the rotor in the overlapped region, wherein the housing edge is configured as transition between a raised outer web and a lowered inner web of the outer cylinder wall as essentially circular bulbous thickened portion, with the lowered web extending about the thickened portion for realizing a sealing, said thickened portion defined by a radial extent which is sized at a widest location at least half as great as a degree of the eccentricity, and wherein the bulbous thickened portion cooperates with an essentially circular or elliptical recess of the disc in periods during operation of the machine in which a higher pressure prevails in an outer sickle-shaped work space, defined by the strips and the outer cylinder wall, than in a suction chamber arranged radially outside the outer cylinder wall in order to form a sealing line which extends over a height of the transition, wherein the recess embraces the thickened portion in the form of a movement path.

2. The spiral compressor of claim 1, wherein the cooperating bulbous thickened portion and the contour of the disc are arranged towards an outlet-side end of the strips.

* * * * *